US012050034B2

(12) United States Patent
Melwin et al.

(10) Patent No.: US 12,050,034 B2
(45) Date of Patent: Jul. 30, 2024

(54) SYSTEM AND METHOD FOR OPERATING A COMPRESSOR OF AN ENERGY EFFICIENT HEAT PUMP

(71) Applicant: Johnson Controls Tyco IP Holdings LLP, Milwaukee, WI (US)

(72) Inventors: Ewin Ramster Melwin, Panvel (IN); Pushpak Doiphode, Thane (IN); Narendra Madhukar Jagtap, Pune (IN); Tejas Mahendra, Pune (IN); Rahul Salunke, Aurangabad (IN); Naveen Ramanagouda Patil, Navi-Mumbai (IN); Jeremy Ryan Smith, Park City, KS (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 0 days.

(21) Appl. No.: 18/457,026

(22) Filed: Aug. 28, 2023

(65) Prior Publication Data

US 2024/0068716 A1 Feb. 29, 2024

(30) Foreign Application Priority Data

Aug. 29, 2022 (IN) ..... 202221049114

(51) Int. Cl.
*F25B 30/02* (2006.01)
*F25B 49/02* (2006.01)

(52) U.S. Cl.
CPC ..... *F25B 30/02* (2013.01); *F25B 49/022* (2013.01); *F25B 2600/0271* (2013.01); *F25B 2700/1931* (2013.01)

(58) Field of Classification Search
CPC F25B 30/02; F25B 49/022; F25B 2600/0271; F25B 2700/1931
See application file for complete search history.

(56) References Cited

U.S. PATENT DOCUMENTS 6,367,269 B1 * 4/2002 Hanson ..... F25B 41/34 62/126
6,622,500 B1 * 9/2003 Archibald ..... B60H 1/3205 62/228.3

(Continued)

FOREIGN PATENT DOCUMENTS

JP 2018173192 A * 11/2018 ..... F25B 1/053

OTHER PUBLICATIONS

Hasegawa, Refrigerator control device, 2018, Full Document (Year: 2018).*

*Primary Examiner* — Nael N Babaa
(74) *Attorney, Agent, or Firm* — Fletcher Yoder, P.C.

(57) ABSTRACT

An energy efficient heat pump includes a variable capacity compressor and a controller communicatively coupled to the variable capacity compressor. The controller is configured to receive a call for heating, determine an upper discharge pressure limit of the energy efficient heat pump, determine a lower discharge pressure limit of the energy efficient heat pump, determine a target discharge pressure value, where the target discharge pressure value is less than or equal to the upper discharge pressure limit and is greater than or equal to the lower discharge pressure limit, and modulate operation of the variable capacity compressor such that a detected discharge pressure of the heat pump approaches the target discharge pressure value.

17 Claims, 8 Drawing Sheets

(56) References Cited

U.S. PATENT DOCUMENTS

| | | | | |
|---|---|---|---|---|
| 2011/0208325 | A1* | 8/2011 | Liu | F25B 1/10 700/28 |
| 2014/0358296 | A1* | 12/2014 | Kaneko | F24F 11/84 700/278 |
| 2015/0082814 | A1* | 3/2015 | Kim | B60H 1/3216 62/56 |
| 2018/0112894 | A1* | 4/2018 | Gurz | F25B 13/00 |

* cited by examiner

SYSTEM AND METHOD FOR OPERATING A COMPRESSOR OF AN ENERGY EFFICIENT HEAT PUMP

CROSS-REFERENCE TO RELATED APPLICATIONS

This application claims priority from and the benefit of India Provisional Patent Application No. 202221049114, entitled "A SYSTEM AND METHOD FOR OPERATING A COMPRESSOR OF AN HVAC SYSTEM," filed Aug. 29, 2022, which is hereby incorporated by reference in its entirety for all purposes.

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Embodiments of the present disclosure are directed to heating, ventilation, and/or air conditioning (HVAC) systems configured to operate with reduced energy consumption. More particularly, embodiments of the present disclosure are directed to energy efficient heat pumps configured to operate in a heating mode to heat a supply air flow with reduced energy consumption by enabling modulated operation of a compressor.

Heating, ventilation, and air conditioning (HVAC) systems are utilized in residential, commercial, and industrial environments to control environmental properties, such as temperature and humidity, for occupants of the respective environments (e.g., enclosed spaces). For example, an HVAC system may include one or more heat exchangers, such as a heat exchanger configured to place an air flow in a heat exchange relationship with a working fluid of a vapor compression circuit (e.g., evaporator, condenser). In general, the heat exchange relationship(s) may cause a change in pressures and/or temperatures of the air flow, the working fluid, or both. The air flow may be directed toward the environment (e.g., enclosed space) to change conditions of the environment. Control features may be employed to control the above-described features such that an environmental parameter (e.g., temperature) of the environment reaches a target value.

Multi-stage HVAC equipment may be employed to provide heating or cooling at a faster rate and/or more efficiently than single stage HVAC equipment. For example, two stage HVAC equipment may be configured to operate in a first stage operating mode and a second stage operating mode that cause conditioning of an air flow at different respective rates. The two stage HVAC equipment may be controlled by a controller that receives a call from a thermostat and determines, in response to the call, if and when to operate the two stage HVAC equipment in the second stage operating mode. Unfortunately, traditional systems may be ill-equipped to determine if and when to initiate second stage operation of the two stage HVAC equipment, leading to inefficient heat exchange and/or lengthy amounts of time to condition the environment (e.g., enclosed space) until the call from the thermostat is satisfied. Further, traditional systems may suffer from compatibility issues associated with certain traditional thermostats and certain multi-stage HVAC equipment, which may inhibit modulated operation of multi-stage HVAC equipment. Accordingly, it is now recognized that improved operation of multi-stage HVAC equipment is desired.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, an energy efficient heat pump includes a variable capacity compressor and a controller communicatively coupled to the variable capacity compressor. The controller is configured to receive a call for heating, determine an upper discharge pressure limit of the energy efficient heat pump, determine a lower discharge pressure limit of the energy efficient heat pump, determine a target discharge pressure value, where the target discharge pressure value is less than or equal to the upper discharge pressure limit and is greater than or equal to the lower discharge pressure limit, and modulate operation of the variable capacity compressor such that a detected discharge pressure of the heat pump approaches the target discharge pressure value.

In another embodiment, a controller of an energy efficient heat pump includes a non-transitory, computer-readable medium having instructions stored thereon that, when executed by processing circuitry of the controller, are configured to cause the controller to receive a call for heating from a non-communicating thermostat, determine an upper discharge pressure limit of the energy efficient heat pump, determine a lower discharge pressure limit of the energy efficient heat pump, determine a target discharge pressure value of the energy efficient heat pump, where the target discharge pressure value is less than or equal to the upper discharge pressure limit and is greater than or equal to the lower discharge pressure limit, iteratively increase the target discharge pressure value, and modulate operation of a compressor of the energy efficient heat pump based on the target discharge pressure value.

In a further embodiment, an energy efficient heat pump includes a compressor configured to operate at variable capacities and a controller configured to communicatively couple to the compressor. The controller is configured to receive a call for heating from a non-communicating thermostat, and in response to receipt of the call for heating, establish a lower discharge pressure limit of the energy efficient heat pump, establish an upper discharge pressure limit of the energy efficient heat pump, determine a target discharge pressure value, where the target discharge pressure value is less than or equal to the upper discharge pressure limit and is greater than or equal to the lower discharge pressure limit, and modulate operation of the compressor such that a detected discharge pressure of the energy efficient heat pump approaches the target discharge pressure value.

BRIEF DESCRIPTION OF THE DRAWINGS

Various aspects of this disclosure may be better understood upon reading the following detailed description and upon reference to the drawings in which.

DETAILED DESCRIPTION

Figure 1:
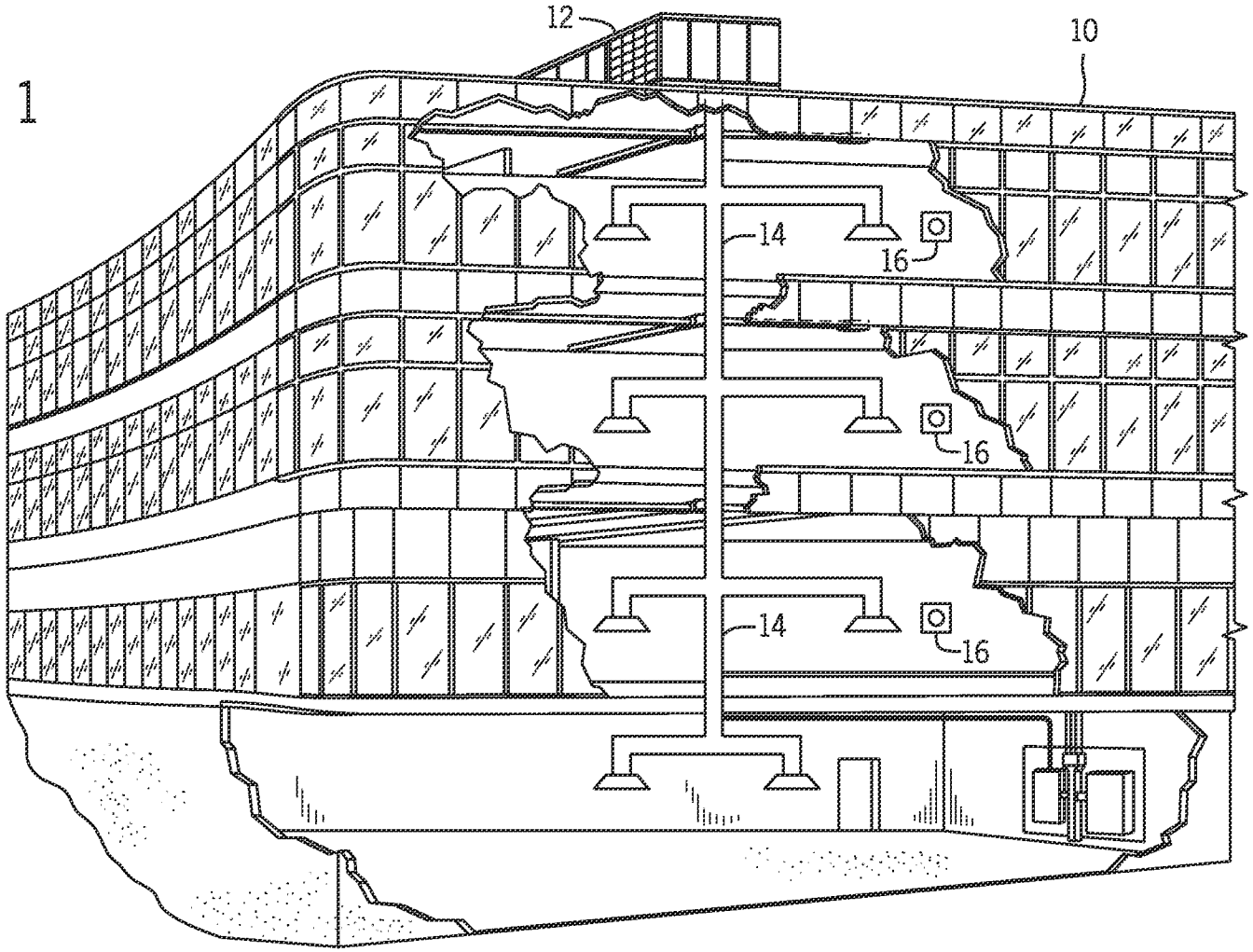
FIG. 1 is a perspective view of an embodiment of a building having a heating, ventilation, and air conditioning (HVAC) system for environmental management that may employ one or more HVAC units, in accordance with an aspect of the present disclosure.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "approximately," "generally," and "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to mean that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to mean that the given feature is within +/−5%, within +/−4%, within +/−3%, within +/−2%, within +/−1%, or even closer, to having the described nature, such as being parallel to another feature, being perpendicular to another feature, and so forth. Further, it should be understood that mathematical terms, such as "planar," "slope," "perpendicular," "parallel," and so forth are intended to encompass features of surfaces or elements as understood to one of ordinary skill in the relevant art, and should not be rigidly interpreted as might be understood in the mathematical arts. For example, a "planar" surface is intended to encompass a surface that is machined, molded, or otherwise formed to be substantially flat or smooth (within related tolerances) using techniques and tools available to one of ordinary skill in the art. Similarly, a surface having a "slope" is intended to encompass a surface that is machined, molded, or otherwise formed to be oriented at an angle (e.g., incline) with respect to a point of reference using techniques and tools available to one of ordinary skill in the art.

The present disclosure is directed to heating, ventilation, and air conditioning (HVAC) systems. For example, an HVAC system may include a vapor compression system that transfers thermal energy between a working fluid, such as a refrigerant, and a fluid to be conditioned, such as air. The vapor compression system includes heat exchangers, such as a condenser and an evaporator, which are fluidly coupled to one another via one or more conduits of a working fluid loop or circuit (e.g., refrigerant circuit). A compressor may be used to circulate the working fluid through the conduits and other components of the working fluid circuit (e.g., an expansion device) and, thus, enable the transfer of thermal energy between components of the working fluid circuit (e.g., between the condenser and the evaporator) and one or more thermal loads (e.g., an environmental air flow, a supply air flow). Additionally or alternatively, the HVAC system may include a heat pump (e.g., a heat pump system) having a first heat exchanger (e.g., a heating and/or cooling coil, an indoor coil, the evaporator) positioned within a building and/or the space to be conditioned, a second heat exchanger (e.g., a heating and/or cooling coil, an outdoor coil, the condenser) positioned in or otherwise fluidly coupled to an ambient environment (e.g., the atmosphere), and a pump (e.g., the compressor) configured to circulate the working fluid (e.g., refrigerant) between the first and second heat exchangers to enable heat transfer between the thermal load (e.g., an air flow to be conditioned) and the ambient environment, for example. The heat pump system is operable to provide both cooling and heating to the space to be conditioned (e.g., a room, zone, or other region within a building) by adjusting a flow of the working fluid through the working fluid circuit. Thus, the heat pump may not include a dedicated heating system, such as a furnace or burner configured to combust a fuel, to enable operation of the HVAC system in the heating mode. As a result, the heat pump operates with reduced greenhouse gas emissions.

The HVAC system may include modulating HVAC equipment, such as a compressor, configured to operate at each of a plurality of operating capacities (e.g., frequencies, speeds, stages, etc.). In accordance with present techniques, the HVAC system may further include a control system configured to enable variable operation of the modulating HVAC equipment to more efficiently satisfy a load or demand of the HVAC system.

In certain traditional systems, modulating (e.g., multi-stage) HVAC equipment, such as variable capacity compressors or variable speed compressors, may be incompatible with single stage thermostats that are designed for single stage HVAC equipment. Similarly, in certain existing systems, modulating HVAC equipment may be incompatible with other (e.g., non-modulating) HVAC equipment. Further, in certain traditional systems, modulating HVAC equipment may have limited compatibility with single stage thermostats and may include controls that are ill-equipped to determine if and when to adjust operation of the modulating HVAC equipment in a manner that provides efficient and timely environmental control of a conditioned space (e.g., enclosed space). Further still, in certain traditional systems, modulating HVAC equipment may be configured to partially interface with multi-stage thermostats, but control aspects associated with the modulating HVAC equipment and the multi-stage thermostat may nevertheless be ill-equipped to determine if and when to adjust (e.g., modulate) operation of the modulating HVAC equipment in a manner that provides efficient and timely environmental control of the conditioned space. For example, existing systems may be unable to modulate operation of the HVAC equipment based on a particular load or demand (e.g., call for conditioning) of the HVAC system and/or based on particular operating conditions of the HVAC system.

Indeed, different embodiments of thermostats (e.g., a communicating thermostat, a conventional thermostat) and/or control circuitry may be incorporated in different HVAC systems, and/or a communication link or coupling between the control system and the components of the vapor compression system may be different for different HVAC systems. As such, it may be difficult to enable the control systems of different HVAC systems to operate in a desirable manner to efficiently operate components of the HVAC system and satisfy a load or demand on the HVAC system. For example, an HVAC system may include a compressor (e.g., a modulating compressor) configured to operate at variable capacities or speeds and may also include an air handler and/or thermostat that is configured to operate with single stage equipment (e.g., a single stage compressor). In other words, the air handler and the thermostat may not be configured to enable operation of the HVAC system in multiple stages. In such instances, the thermostat and/or the air handler may be unable to adequately communicate with the modulating compressor to enable operation of the compressor across a range of capacities or speeds.

Thus, it is presently recognized that there is a desire to improve control systems of HVAC systems to enable operation of different types of HVAC equipment with one another in a more efficient manner. Accordingly, embodiments of the present disclosure are directed to a control system configured to enable variable operation of modulating HVAC equipment (e.g., a variable speed compressor) when the modulating HVAC equipment is utilized with non-modulating (e.g., non-communicating) HVAC equipment. Thus, present embodiments enable more efficient control and operation of the HVAC system to satisfy a load or demand on the HVAC system.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air-cooled device that implements a refrigeration loop to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one working fluid circuit configured to operate in different modes.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
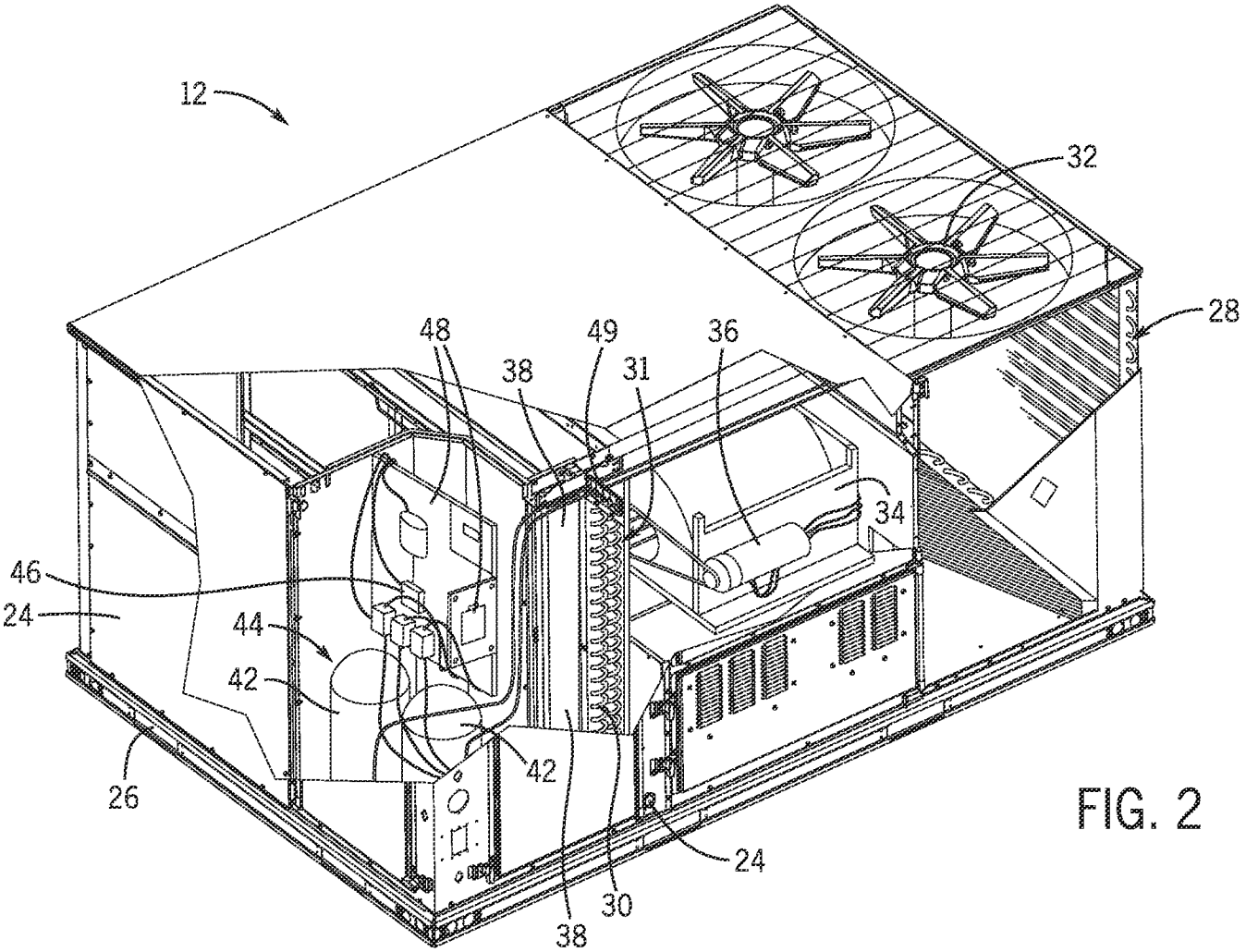
FIG. 2 is a perspective view of an embodiment of a packaged HVAC unit that may be used in an HVAC system, in accordance with an aspect of the present disclosure.

FIG. 2 is a perspective view of an embodiment of the HVAC unit 12. In the illustrated embodiment, the HVAC unit 12 is a single package unit that may include one or more independent working fluid circuits and components that are tested, charged, wired, piped, and ready for installation. The HVAC unit 12 may provide a variety of heating and/or cooling functions, such as cooling only, heating only, cooling with dehumidification, or cooling with reheat, and so forth. As described above, the HVAC unit 12 may directly cool and/or heat an air flow provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit onto "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more working fluid circuits. Tubes within the heat exchangers 28 and 30 may circulate a working fluid (e.g., refrigerant), such as R-410A, through the heat exchangers 28 and 30. The tubes may be of various types, such as multichannel tubes, conventional copper or aluminum tubing, and so forth. Together, the heat exchangers 28 and 30 may implement a thermal loop in which the working fluid undergoes phase changes and/or temperature changes as it flows through the heat exchangers 28 and 30 to produce heated and/or cooled air. For example, the heat exchanger 28 may function as a condenser where heat is released from the working fluid to ambient air, and the heat exchanger 30 may function as an evaporator where the working fluid absorbs heat to cool an air flow. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal loop. Compressors 42 increase the pressure and temperature of the working fluid before the working fluid enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
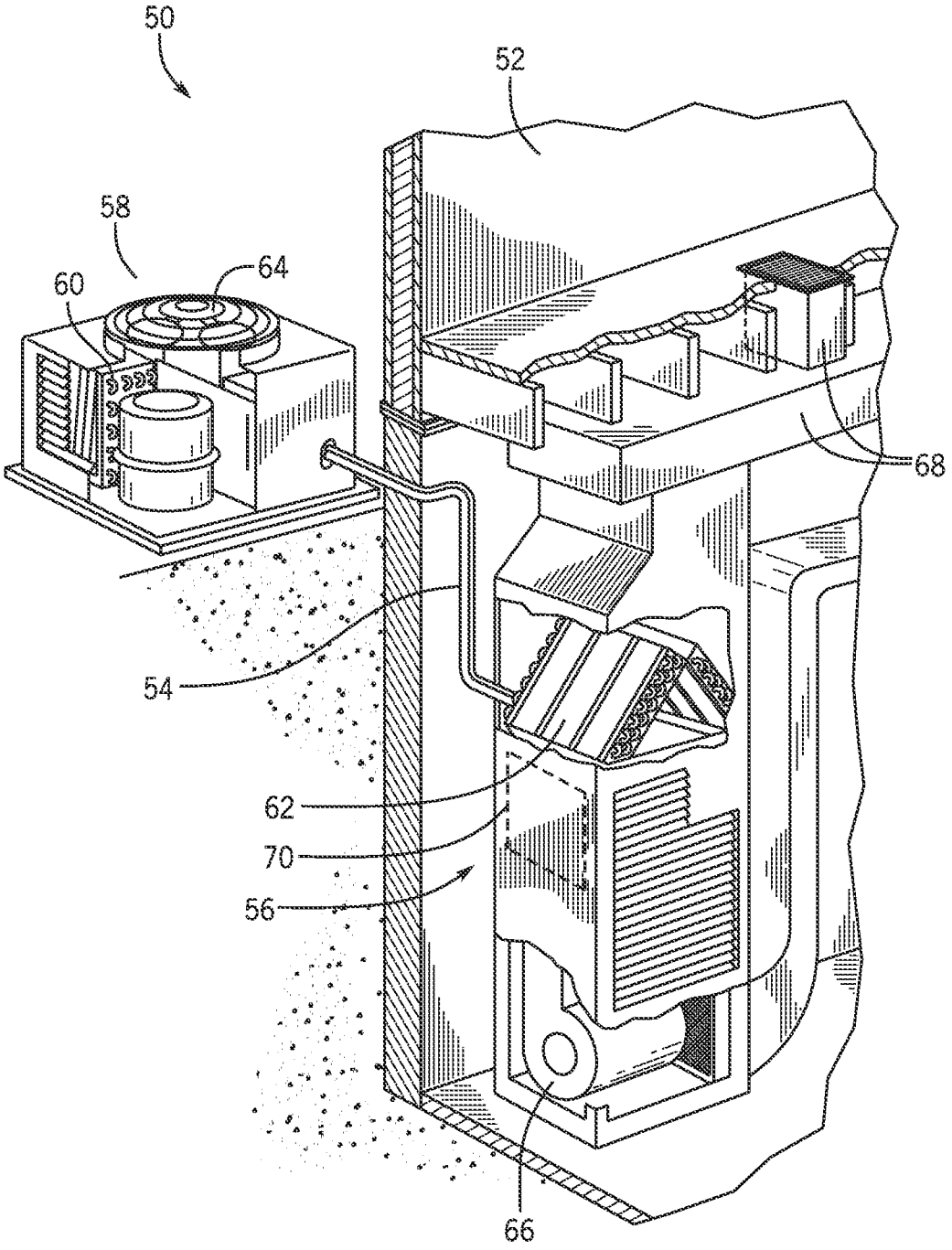
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include working fluid conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The working fluid conduits 54 transfer working fluid between the indoor unit 56 and the outdoor unit 58, typically transferring primarily liquid working fluid in one direction and primarily vaporized working fluid in an opposite direction.

When the system shown in FIG. 3 is operating as an air conditioner, a heat exchanger 60 in the outdoor unit 58 serves as a condenser for re-condensing vaporized working fluid flowing from the indoor unit 56 to the outdoor unit 58 via one of the working fluid conduits 54. In these applications, a heat exchanger 62 of the indoor unit functions as an evaporator. Specifically, the heat exchanger 62 receives liquid working fluid, which may be expanded by an expansion device, and evaporates the working fluid before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop operation of the working fluid loop temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate working fluid and thereby cool air entering the outdoor unit 58 as the air passes over the outdoor heat exchanger 60. The indoor heat exchanger 62 will receive a stream of air blown over it and will heat the air by condensing the working fluid.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower or fan 66 passes over the tubes or pipes and extracts heat from the combustion products. The heated air may then be routed from the furnace system 70 to the ductwork 68 for heating the residence 52.

Figure 4:
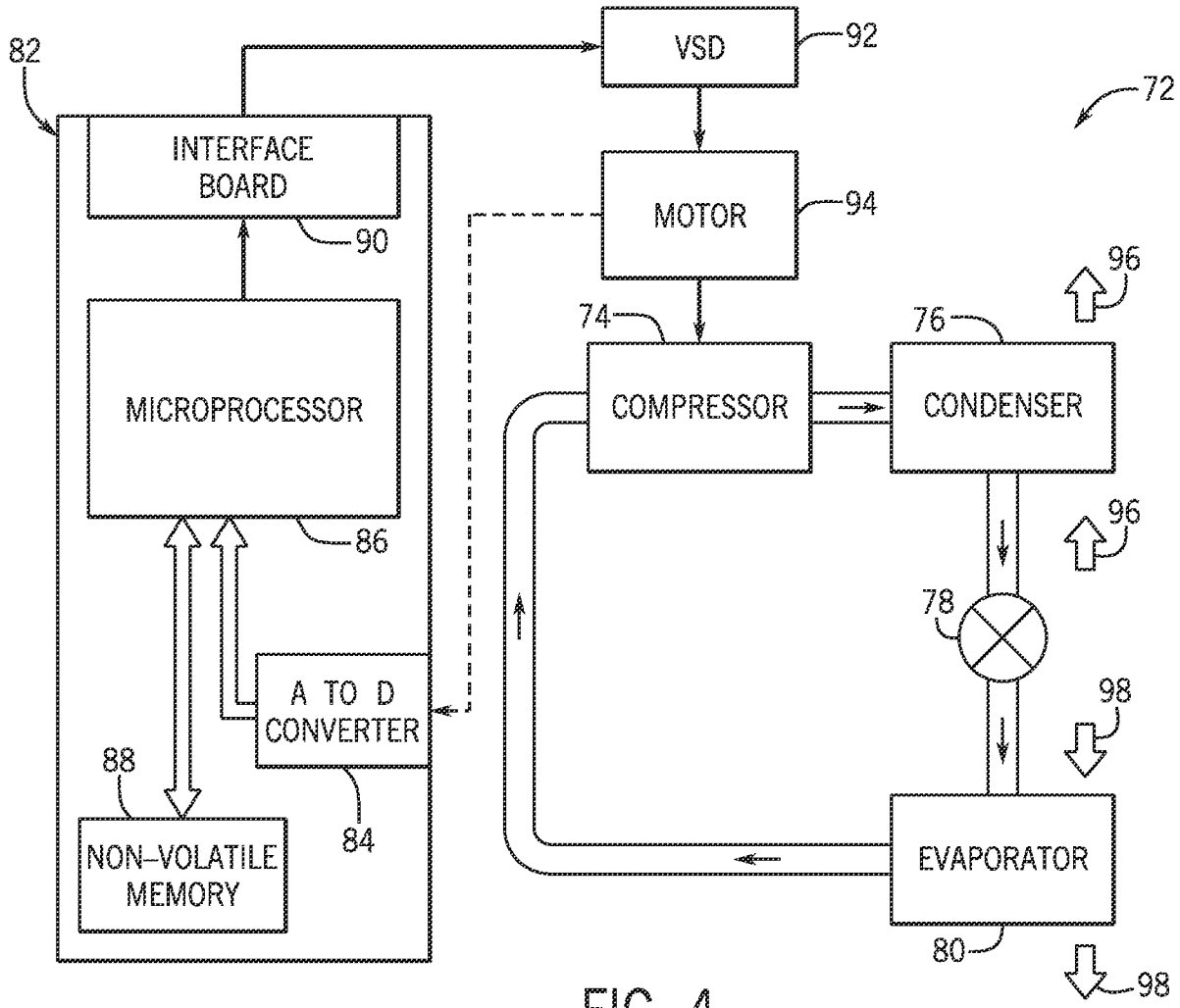
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a working fluid (e.g., refrigerant) through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a working fluid vapor and delivers the vapor to the condenser 76 through a discharge passage. In some embodiments, the compressor 74 may be a centrifugal compressor. The working fluid vapor delivered by the compressor 74 to the condenser 76 may transfer heat to a fluid passing across the condenser 76, such as ambient or environmental air 96. The working fluid vapor may condense to a working fluid liquid in the condenser 76 as a result of thermal heat transfer with the environmental air 96. The liquid working fluid from the condenser 76 may flow through the expansion device 78 to the evaporator 80.

The liquid working fluid delivered to the evaporator 80 may absorb heat from another air flow, such as a supply air flow 98 provided to the building 10 or the residence 52. For example, the supply air flow 98 may include ambient or environmental air, return air from a building, or a combination of the two. The liquid working fluid in the evaporator 80 may undergo a phase change from the liquid working fluid to a working fluid vapor. In this manner, the evaporator 80 may reduce the temperature of the supply air flow 98 via thermal heat transfer with the working fluid. Thereafter, the vapor working fluid exits the evaporator 80 and returns to the compressor 74 by a suction line to complete the loop.

In some embodiments, the vapor compression system 72 may further include a reheat coil in addition to the evaporator 80. For example, the reheat coil may be positioned downstream of the evaporator relative to the supply air flow 98 and may reheat the supply air flow 98 when the supply air flow 98 is overcooled to remove humidity from the supply air flow 98 before the supply air flow 98 is directed to the building 10 or the residence 52.

Any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Further, any of the systems illustrated in FIGS. 1-4 may include modulating HVAC equipment, such as a multi-stage or variable capacity compressor, configured to operate in multiple stages of operation (e.g., variable capacities) and a control system (e.g., a controller) configured to enable modulated operation of the modulating HVAC equipment. As previously mentioned, present embodiments enable modulated operation of a variable capacity compressor that is incorporated with an HVAC system having an air handler (e.g., indoor unit) and/or a thermostat that is not configured to provide certain information (e.g., a detected temperature of a conditioned space) that may otherwise enable modulated operation of the variable capacity compressor. For example, the air handler and/or thermostat may be a non-communicating or conventional embodiment that is configured to output limited control signals. Control systems and methods utilizing the present techniques are nevertheless configured to enable modulated operation of the compressor without the information typically provided by a communicating air handler and/or communicating thermostat. For example, the presently disclosed techniques enable modulated operation of a compressor based on a demand or load (e.g., heating load) on the HVAC system. The control system may additionally or alternatively establish and adjust (e.g., iteratively adjust) one or more target operating parameters of the compressor (e.g., a target discharge pressure) to enable modulated operation of the compressor. In this way, the presently disclosed techniques enable more efficient operation of the HVAC system having different types (e.g., communicating, non-communicating) HVAC equipment. It should be appreciated that the techniques described herein may be incorporated with HVAC systems configured as air conditioning systems, heat pumps, and/or any other suitable HVAC system having HVAC equipment configured for modulated operation and HVAC equipment that is not configured for modulated operation, such as non-communicating air handlers and/or non-communicating thermostats.

Figure 5:
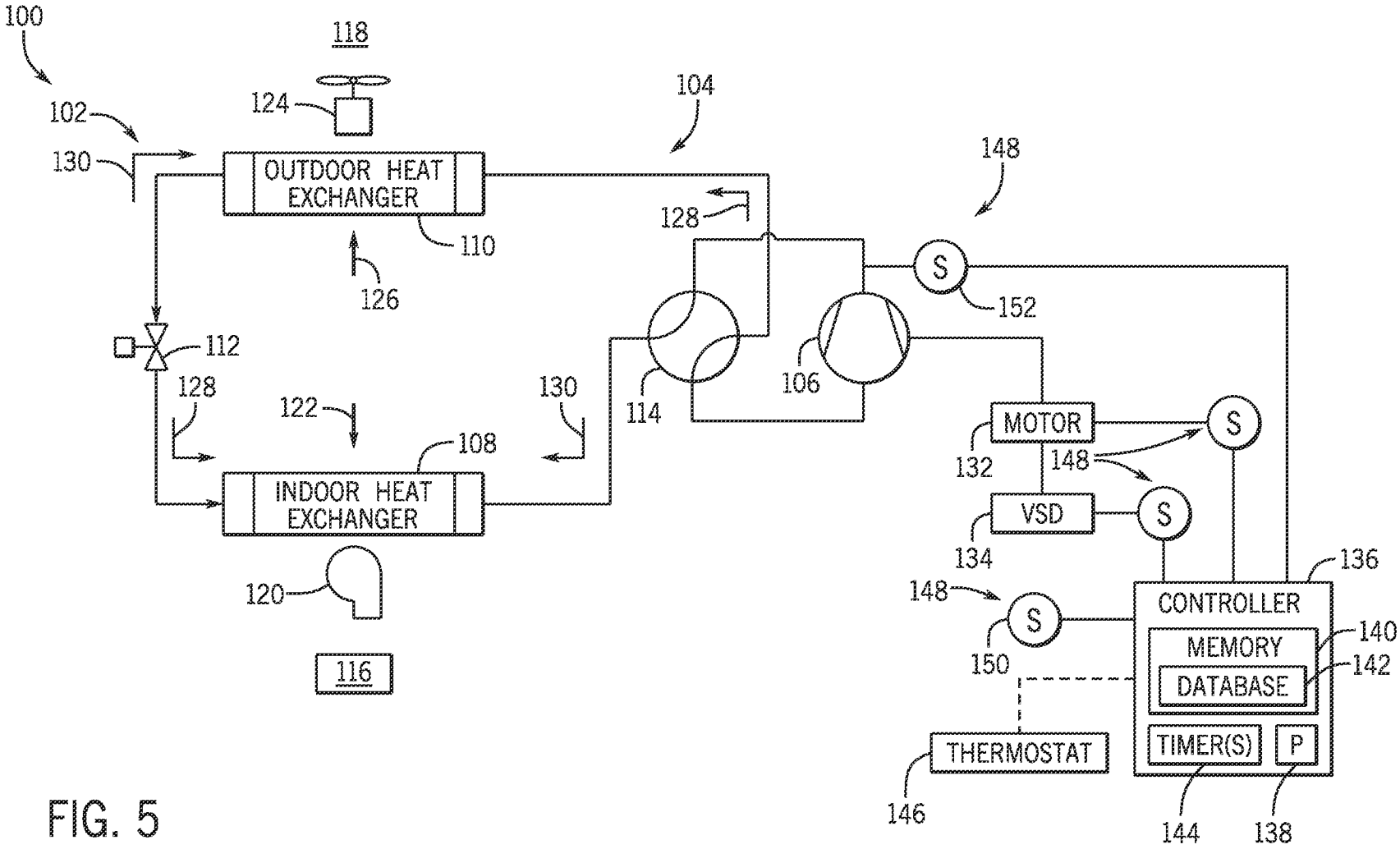
FIG. 5 is a schematic of an embodiment of an HVAC system having a controller configured to modulate operation of a compressor of the HVAC system, in accordance with an aspect of the present disclosure.

To provide context for the following discussion, FIG. 5 is a schematic of an embodiment of an HVAC system 100 (e.g., heat pump system, energy efficient heat pump system), which may be incorporated any of the systems or units illustrated in FIGS. 1-4 or any other suitable HVAC system. The HVAC system 100 includes certain elements similar to those discussed above. For example, the HVAC system 100 includes a vapor compression system 102 having a working fluid circuit 104 configured to circulate a working fluid therethrough. The working fluid circuit 104 includes a compressor 106, an indoor heat exchanger 108 (e.g., evaporator, first heat exchanger), an outdoor heat exchanger 110 (e.g., condenser, second heat exchanger), and an expansion valve 112. The working fluid circuit 104 also includes a reversing valve 114 (e.g., switch-over valve) configured to adjust (e.g., reverse) a flow direction of a working fluid along the working fluid circuit 104.

The indoor heat exchanger 108 may be in thermal communication with (e.g., fluidly coupled to) a thermal load 116 (e.g., a room, space, and/or device) serviced by the HVAC system 100, and the outdoor heat exchanger 110 may be in thermal communication with an ambient environment 118 (e.g., the atmosphere) surrounding the HVAC system 100. The HVAC system 100 also includes a first fan 120 (e.g., blower, indoor fan, supply air fan) configured to direct a first air flow 122 across the indoor heat exchanger 108 to facilitate heat exchange between working fluid within the indoor heat exchanger 108 and the first air flow 122 directed to the thermal load 116. A second fan 124 (e.g., outdoor fan, condenser fan) may direct a second air flow 126 across the outdoor heat exchanger 110 to facilitate heat exchange between working fluid within the outdoor heat exchanger 110 and the second air flow 126 of the ambient environment 118. The expansion valve 112 is disposed along the working fluid circuit 104 between the indoor heat exchanger 108 and the outdoor heat exchanger 110 and may be configured to regulate (e.g., throttle) a working fluid flow and/or a working fluid pressure differential between the indoor heat exchanger 108 and the outdoor heat exchanger 110.

During operation of the HVAC system 100 in a cooling mode, the compressor 106 may direct working fluid through the working fluid circuit 104, the indoor heat exchanger 108, and the outdoor heat exchanger 110 in a first flow direction 128. While receiving working fluid in the first flow direction 128, the indoor heat exchanger 108, which is in thermal communication with the thermal load 116, may operate as an evaporator. Thus, working fluid flowing through the indoor heat exchanger 108 may absorb thermal energy from the first air flow 122 directed to the thermal load 116. The outdoor heat exchanger 110, which may be positioned in the ambient environment 118 surrounding the HVAC system 100 (e.g., heat pump system), may operate as a condenser to reject the heat absorbed by the working fluid flowing from the indoor heat exchanger 108 to the second air flow 126 (e.g., ambient air flow) directed across the outdoor heat exchanger 110. During operation of the HVAC system 100 in a heating mode, the reversing valve 114 enables the compressor 106 to direct working fluid through the working fluid circuit 104, the indoor heat exchanger 108, and the outdoor heat exchanger 110 in a second flow direction 130, opposite the first flow direction 128. While receiving working fluid in the second flow direction 130, the indoor heat exchanger 108 may operate as a condenser instead of an evaporator, and the outdoor heat exchanger 110 may operate as an evaporator instead of a condenser. As such, the indoor heat exchanger 108 may receive (e.g., from the compressor 106) a flow of heated working fluid to reject heat to the first air flow 122 directed to the thermal load 116 and thereby facilitate heating of the thermal load 116.

In accordance with present techniques, the compressor 106 is a variable capacity compressor (e.g., a variable speed compressor). To this end, the HVAC system 100 also includes a motor 132 and a variable speed drive (VSD) 134 configured to enable operation of the compressor 106 at various capacities or speeds. For example, the VSD 134 may be a variable frequency drive configured to vary an input voltage and/or frequency supplied to the motor 132 to enable variable speed operation of the motor 132 and the compressor 106. It should be appreciated that the motor 132 and/or the VSD 134 may be considered components of the compressor 106 throughout the following discussion.

In some embodiments, the HVAC system 100 may be configured as a split system, such as the residential heating and cooling system 50 described above. For example, the compressor 106 and the outdoor heat exchanger 110 may be packaged in an outdoor unit (e.g., outdoor unit 58), and the indoor heat exchanger 108 may be packaged in an indoor unit (e.g., indoor unit 56). However, in other embodiments, the HVAC system 100 may be configured as a packaged system or unit.

In accordance with present techniques, the compressor 106 may be controlled to enable more efficient operation of the HVAC system 100. For example, operation of compressor 106 may be modulated to provide variable capacity operation of the compressor 106, which may enable operation of the HVAC system 100 to satisfy a demand of the thermal load 116 more efficiently (e.g., with reduced energy consumption). Indeed, present embodiments of the HVAC system 100 (e.g., heat pump system) are configured to enable more efficient operation to satisfy a heating demand of the thermal load 116, such as with reduced energy consumption and without generation of combustion products and/or greenhouse gases typically associated with operation of a furnace. The compressor 106 may be controlled based on an operating mode of the HVAC system 100, based on operating conditions or parameters of the HVAC system 100, based on a load or demand on the HVAC system 100, and/or based on other suitable factors. Indeed, present techniques further enable modulated operation of the compressor 106 with conventional or non-communicating components that may be incorporated with the HVAC system 100 and may not be configured to provide data and/or information that is traditionally utilized to enable modulated operation of compressors.

To this end, the HVAC system 100 includes a controller 136 (e.g., a control system, a control panel, control circuitry) that is communicatively coupled to one or more components of the HVAC system 100 (e.g., compressor 106, motor 132, VSD 134) and is configured to monitor, adjust, and/or otherwise control operation of the components of the HVAC system 100. For example, one or more control transfer devices, such as wires, cables, wireless communication devices, and the like, may communicatively couple the compressor 106, the motor 132, the VSD 134, and/or any other suitable components of the HVAC system 100 to the controller 136. That is, the compressor 106, the motor 132, and/or the VSD 134 may each have one or more communication components that facilitate wired or wireless (e.g., via a network) communication with the controller 136. In some embodiments, the communication components may include a network interface that enables the components of the HVAC system 100 to communicate via various protocols such as EtherNet/IP, ControlNet, DeviceNet, or any other communication network protocol. Alternatively, the communication components may enable the components of the HVAC system 100 to communicate via mobile telecommunications technology, Bluetooth®, near-field communications technology, and the like. As such, the compressor 106, the motor 132, and/or the VSD 134 may wirelessly communicate data between each other. In other embodiments, operational control of certain components of the HVAC system 100 may be regulated by one or more relays or switches (e.g., a 24 volt alternating current [VAC] relay).

In some embodiments, the controller 136 may be a component of or may include the control panel 82. In other embodiments, the controller 136 may be a standalone controller, a dedicated controller, a group of controllers, multiple, separate controllers, an outdoor unit controller packaged with the compressor 106, or another suitable controller included in the HVAC system 100. In any case, the controller 136 is configured to control components of the HVAC system 100 in accordance with the techniques discussed herein. The controller 136 includes processing circuitry 138, such as a microprocessor, which may execute software for controlling the components of the HVAC system 100. The processing circuitry 138 may include multiple microprocessors, one or more "general-purpose" microprocessors, one or more special-purpose microprocessors, and/or one or more application specific integrated circuits (ASICS), or some combination thereof. For example, the processing circuitry 138 may include one or more reduced instruction set (RISC) processors.

The controller 136 may also include a memory device 140 (e.g., a memory) that may store information, such as executable instructions, control software, look up tables, configuration data, etc. The memory device 140 may include a volatile memory, such as random access memory (RAM), and/or a nonvolatile memory, such as read-only memory (ROM). The memory device 140 may store a variety of information and may be used for various purposes. For example, the memory device 140 may store processor-executable instructions including firmware or software for the processing circuitry 138 to execute, such as instructions for controlling components of the HVAC system 100 (e.g., compressor 106, motor 132, VSD 134). Indeed, it should be appreciated that the memory device 140 may include executable instructions for performing any of the techniques disclosed herein. In some embodiments, the memory device 140 is a tangible, non-transitory, machine-readable-medium that may store machine-readable instructions for the processing circuitry 138 to execute. The memory device 140 may include ROM, flash memory, a hard drive, or any other suitable optical, magnetic, or solid-state storage medium, or a combination thereof. The memory device 140 may store data, instructions, and any other suitable data. For example, the memory device 140 may include a database 142 configured to store one or more reference values, operating parameter values, calculated values, historical values, and/or any other suitable data to enable operation of the HVAC system 100 in accordance with the presently disclosed techniques.

In some embodiments, the controller 136 may include one or more timers 144 (e.g., one or more clocks). For example, the controller 136 may include executable instructions stored on the memory device 140, and the processing circuitry 138 may be configured to execute the executable instructions to operate one or more of the timers 144 to enable monitoring and/or tracking of one or more time durations associated with operations of the HVAC system 100 utilizing the present techniques, as described in greater detail below. In some embodiments, time durations and/or time duration thresholds associated with the one or more timers 144 may be stored in the memory device 140, such as in the database 142.

The controller 136 may also be coupled to one or more additional control components of the HVAC system 100. For example, in the illustrated embodiment, the controller 136 is communicatively coupled to a thermostat 146. As will be appreciated, the thermostat 146 may be associated with a space conditioned by the HVAC system 100 and may be configured to receive a user input corresponding to an operating parameter set point (e.g., temperature set point). Based on the user input, the thermostat 146 may output a call for conditioning (e.g., a call for heating, 24 volt signal, electrical signal), and the call for conditioning may be received by the controller 136. For example, the thermostat 146 may be disposed within a space conditioned by the HVAC system 100, and the controller 136 may be disposed within an enclosure or unit having the compressor 106 (e.g., outdoor unit 58). However, the thermostat 146 may be a conventional or non-communicating thermostat, in some embodiments, and may not be configured to provide data or information typically referenced and utilized to enable modulated operation of the compressor 106. For example, the thermostat 146 may not be configured to collect and/or transmit data indicative of a measured temperature within the conditioned space to the controller 136. In some embodiments, the controller 136 may additionally or alternatively be communicatively coupled to an air handler controller (e.g., controller of indoor unit 56) having similar capability limitations as the thermostat 146. That is, the controller 136 may be communicatively coupled to a conventional or non-communicating air handler controller. Nevertheless, the controller 136 incorporating the presently disclosed techniques is configured to enable modulated operation of the compressor 106 to satisfy a call for conditioning received from the thermostat 146. For example, the controller 136 may be configured to determine and establish a desired operating parameter (e.g., discharge pressure) according to which the HVAC system 100 (e.g., compressor 106) may operate. More specifically, the controller 136 may be configured to determine, establish, and adjust a variable target operating parameter and enable operation (e.g., modulated operation) of the compressor 106 to approach and/or reach the target operating parameter. It should be appreciated that the disclosed techniques may also be utilized in embodiments of the HVAC system 100 in which the thermostat 146 is a communicating thermostat.

The controller 136 is also communicatively coupled to one or more sensors 148 of the HVAC system 100. The one or more sensors 148 are configured to detect one or more operating parameters of the HVAC system 100 and provide feedback and/or data indicative of the operating parameters to the controller 136. For example, a first sensor 150 of the one or more sensors 148 may be an outdoor or ambient temperature sensor configured to detect or measure a temperature of an ambient environment surrounding the HVAC system 100. As another example, a second sensor 152 of the one or more sensors 148 may be a working fluid sensor configured to measure or detect an operating parameter (e.g., temperature, pressure) of the working fluid circulated through the working fluid circuit 104. In some embodiments, the second sensor 152 may be disposed along the working fluid circuit 104 downstream of the compressor 106 relative to a flow direction of the working fluid through the working fluid circuit 104 (e.g., compressor 106) and may be configured to detect a discharge pressure of the working fluid discharged by the compressor 106. The one or more sensors 148 may additionally or alternatively include other sensors, such as sensors configured to detect one or more operating parameters of the compressor 106, the motor 132, the VSD 134, and/or other components of the HVAC system 100. As described in further detail below, the controller 136 may utilize data and/or feedback received from the one or more sensors 148 to enable modulated operation of the compressor 106 in accordance with present techniques.

Figure 6:
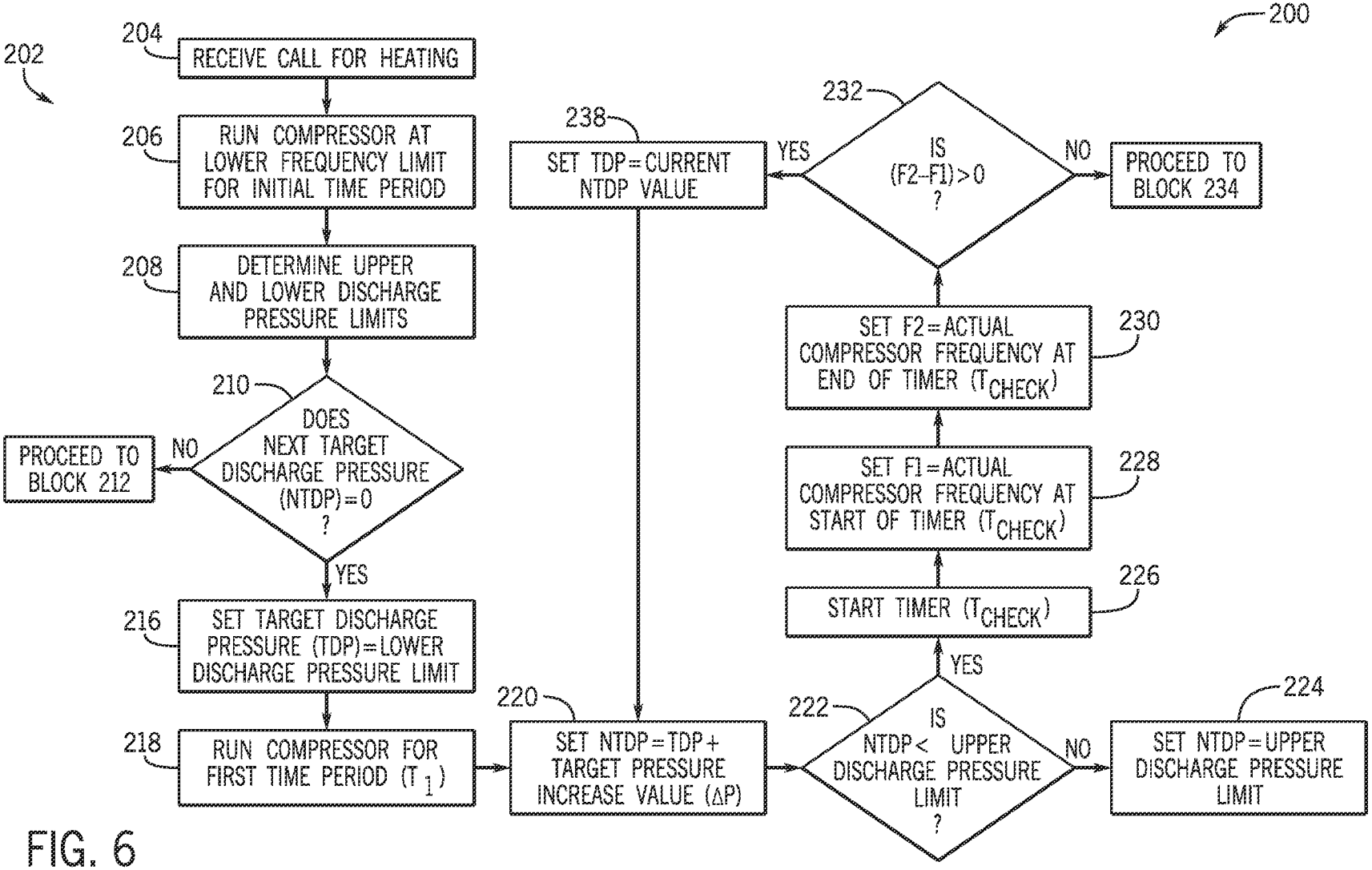
FIG. 6 is a process flow diagram of an embodiment of a method for controlling operation of an HVAC system, in accordance with an aspect of the present disclosure.

With the foregoing in mind, FIG. 6 is a process flow diagram of an embodiment of a method 200 (e.g., control sequence, one or more control sequences, algorithm) for operating the HVAC system 100 (e.g., the compressor 106) and to enable modulated operation of the compressor 106 (e.g., in a heating mode of the HVAC system 100). In this way, the method 200 enables more efficient operation of the HVAC system 100, such as with reduced power consumption. As will be appreciated, the method 200 may be performed by the controller 136 (e.g., outdoor unit controller, compressor controller, one or more controllers). For example, computer-executable instructions or code for performing the method 200 may be stored on the memory device 140, and the processing circuitry 138 may execute the instructions to perform the method 200. In some embodiments, one or more steps of the method 200 may be performed by another controller of the HVAC system 100 and/or by a controller remote from the HVAC system 100. In additional or alternative embodiments, multiple components or systems may perform the steps of the method 200. It should also be noted that additional steps may be performed with respect to the depicted method 200. Moreover, certain steps of the method 200 may be removed, modified, and/or performed in a different order. In some embodiments, certain steps of the method 200 may not be performed based on a configuration of the HVAC system 100, such as based on a configuration of the compressor 106. Further still, the steps of the method 200 may be performed in any suitable relation with one another, such as in response to one another and/or in parallel with one another. In some implementations, the method 200 may include multiple control schemes (e.g., loops, branches, portions, etc.). For example, the illustrated embodiment depicts an embodiment of a first control scheme 202 of the method 200. Additional embodiments of control schemes of the method 200 are described in further detail below.

At block 204, a call for heating is received. For example, the controller 136 may receive the call for cooling from the thermostat 146. As mentioned above, the call for heating may be output by the thermostat 146 and may be received by the controller 136 as a 24-volt electrical signal (e.g., a signal configured to initiate operation of the compressor 106). However, as the thermostat 146 may be a conventional or non-communicating thermostat, the call for heating may not include data typically provided by communicating thermostats (e.g., data indicative of a measured temperature within the conditioned space). In some embodiments, the call for heating may be transmitted to the controller 136 by another system or controller of the HVAC system 100, such as a non-communicating or conventional indoor unit or air handler controller. In conjunction with and/or in response to the call for heating, the reversing valve 114 of the working fluid circuit 104 (e.g., heat pump) may be a de-energized state. In the de-energized state, the reversing valve 114 may be configured to direct working fluid through the working fluid circuit 104 in the second flow direction 130 to enable operation of the HVAC system 100 (e.g., heat pump) in the heating mode, as discussed above.

In response to receipt of the call for heating, the controller 136 may operate the compressor 106 at a lower frequency limit (e.g., minimum allowable frequency, minimum allowable capacity, lower capacity limit) for an initial time period (e.g., duration of time, threshold time period), as indicated by block 206. For example, the lower frequency limit may be a minimum allowable frequency at which the compressor 106 may be operated. In some embodiments, the lower frequency limit may be determined based on regulatory standards, target or desired operating (e.g., efficiency) metrics, and/or other restrictions or parameters. Additionally or alternatively, the lower frequency limit may be determined based on a type of the compressor 106, a model of the compressor 106, a capacity of the compressor 106, a capacity of the HVAC system 100, another characteristic of the HVAC system 100, or any combination thereof. In some embodiments, the controller 136 may output one or more control signals to the VSD 134, the motor 132, the compressor 106, or any combination thereof to enable operation of the compressor 106 at the lower frequency limit. Further, the controller 136 may monitor or track operation of the compressor 106 at the lower frequency limit for the initial time period utilizing one or more of the timers 144 (e.g., a first timer). In some embodiments, the initial time period may be a predetermined, constant, and/or fixed period or duration of time. For example, the initial time period may be approximately 3 minutes, 4 minutes, 5 minutes, 6 minutes, or any other suitable period of time.

Upon a determination that the initial time period has lapsed (e.g., as indicated by the timer 144), the controller 136 may determine an upper discharge pressure limit (e.g., threshold value) and a lower discharge pressure limit (e.g., threshold value) within which the compressor 106 and/or HVAC system 100 is to be operated during the operating cycle (e.g., heating cycle) of the HVAC system 100, as indicated by block 208. That is, the controller 136 may determine upper and lower discharge pressure limits to be referenced as operational boundaries during operation of the compressor 106 and the HVAC system 100 to satisfy the call for heating received at block 204. The upper and lower discharge pressure limits may be determined in any suitable manner. In some embodiments, the upper discharge pressure limit and/or the lower discharge pressure limit may be determined and/or selected based on predetermined values stored in the memory device 140. In such embodiments, a respective predetermined value of the lower discharge pressure limit and/or upper discharge pressure limit may designated based on any suitable parameters or factors, such as a type or model of the compressor 106, a capacity of the compressor 106, a configuration of the HVAC system 100, a model of the HVAC system 100, other operating conditions or limits of the HVAC system 100, testing data, empirical data, testing data (e.g., aggregated testing data for a particular model of the compressor 106 and/or HVAC system 100), regulatory standards, target or desired operating (e.g., efficiency) metrics, or any combination thereof.

Additionally or alternatively, the upper discharge pressure limit and/or the lower discharge pressure limit may be determined based on one or more equations that may be stored in the memory device 140. The one or more equations may utilize any suitable inputs to enable calculation of the upper discharge pressure limit and/or the lower discharge pressure limit. For example, the equations may be utilized using empirical data, test data, regulatory parameters, operating parameters, constant values, predetermined parameters, and/or any other suitable input to determine the upper discharge pressure limit and/or the lower discharge pressure limit.

Once the upper discharge pressure limit and the lower discharge pressure limit are determined (e.g., by the controller 136), the method 200 may proceed to block 210. At block 210, the controller 136, for example, may determine whether a Next Target Discharge Pressure (NTDP) value (e.g., stored target discharge pressure value, future target discharge pressure value, subsequent target discharge pressure value, expected target discharge pressure value) of the HVAC system 100 equals zero (e.g., null). For example, the memory device 140 (e.g., database 142) may be configured to store an NTDP value associated with the HVAC system 100. In some embodiments, the NTDP value stored on the memory device 140 may be a non-zero value and may be associated with a previous operating cycle (e.g., heating cycle) of the HVAC system 100 (e.g., heat pump), such as most recent operating or heating cycle of the HVAC system 100 prior to receipt of the call for heating at block 204. For example, the NTDP value stored in the memory device 140 may be the last NTDP value determined or established by the controller 136 during the most recent operating (e.g., heating) cycle. In some embodiments, the NTDP value may be reset to zero (e.g., in the memory device 140 and/or database 142) in response to an interruption in supply of power to the HVAC system 100 and/or in response to a hard reset of the HVAC system 100.

Based on a determination (e.g., via the controller 136) that the NTDP value does not equal zero at block 210, the method 200 may proceed to block 212 of a third control scheme 214 of the method 200. The third control scheme 214, including block 212, is described in further detail below with reference to FIG. 8. Based on a determination (e.g., via the controller 136) that the NTDP value (e.g., stored in the memory device 140) equals zero at block 210 (e.g., resulting from a hard reset of the HVAC system 100 or upon a new installation of the HVAC system 100), the method 200 may proceed to block 216 of the first control scheme 202 of the method 200. At block 216, the controller 136 may set (e.g., designate, establish) the lower discharge pressure limit determined at block 208 as a Target Discharge Pressure (TDP) (e.g., TDP value, discharge pressure set point) of the HVAC system 100. The TDP value may be stored in the memory device 140, in some embodiments. In general, with the TDP established, the HVAC system 100 may be operated to achieve the TDP. That is, operation of one or more components of the HVAC system 100, such as the compressor 106, may be adjusted or modified (e.g., during the heating mode) to cause a measured discharge pressure of the HVAC system 100 to approach and/or reach the TDP. As will be appreciated, the discharge pressure may correspond to a pressure of the working fluid discharged at a discharge side and/or from an outlet of the compressor 106. Thus, in order to achieve the TDP, the controller 136 may be configured to adjust operation of the compressor 106 based on feedback received from one or more of the sensors 148, such as the second sensor 152 disposed along the working fluid circuit 104. The second sensor 152 may be configured to detect a discharge pressure of the working fluid exiting the compressor 106. In some embodiments, the controller 136 may be configured to adjust an operating parameter of the compressor 106, the motor 132, and/or the VSD 134 based on the data and/or feedback received from the second sensor 152. In this way, the controller 136 may modulate operation of the compressor 106 to cause the measured discharge pressure to approach and/or reach the TDP.

Next, at block 218, the compressor 106 may be operated for a first time period ($T_1$). As similarly discussed above, the first time period may be monitored or tracked based on operation of one or more of the timers 144 (e.g., a second timer) of the controller 136. The first time period may be any suitable time period. For example, the first time period may be a predetermined or fixed value (e.g., 3 minutes, 4 minutes, 5 minutes, 6 minutes, etc.), which may be stored in the memory device 140 and/or the database 142. During the first time period, the controller 136 may operate the HVAC system 100 (e.g., heat pump) and/or may adjust operation of the HVAC system 100 (e.g., the compressor 106) to cause the discharge pressure of the working fluid detected by the second sensor 152 to approach the TDP established at block 216. In some embodiments, the controller 136 may be configured to adjust a voltage and/or frequency applied to the motor 132 by the VSD 134 to cause a change in the discharge pressure of the working fluid (e.g., working fluid circuit 104).

Upon lapse of the first time period (e.g., as determined by one of the timers 144), the method 200 may proceed to block 220. At block 220, the controller 136 may set (e.g., establish) the NTDP as an updated value (e.g., future TDP value, subsequent TDP value, expected TDP value). The updated or new value of the NTDP may be determined by adding a differential pressure value ($\Delta P$) (e.g., increment, predetermined value, fixed value, first differential pressure value) to the TDP (e.g., current TDP) designated at block 216. The differential pressure value may be a target pressure increase value or target pressure decrease value. In some embodiments, the differential pressure value may be stored in the memory device 140 (e.g., database 142) and may be referenced by the controller 136 to perform the step at block 220. The differential pressure value may be any suitable value having any suitable units (e.g., 0.005 Megapascals [MPa], 0.01 MPa, 0.015 MPa, or any other suitable value). The updated value of the NTDP may be stored in the memory device 140 and/or database 142. In accordance with present techniques, the NTDP is therefore increased at block 220.

After the NTDP value (e.g., future TDP value, subsequent TDP value, expected TDP value) is updated at block 220, the method 200 may proceed to block 222. At block 222, the controller 136, for example, may determine whether the NTDP value established or updated at block 220 is less than the upper discharge pressure limit determined at block 208. Based on a determination that the NTDP is not less than the upper discharge pressure limit, the upper discharge pressure limit may be established as the NTDP, as indicated by block 224. In other words, the controller 136 may update or adjust the NTDP to be equal to the upper discharge pressure limit. The NTDP updated as the upper discharge pressure limit may be stored in the memory device 140, and the controller 136 may continue to operate the HVAC system 100 (e.g., heat pump) utilizing the upper discharge pressure limit as the NTDP for a remaining duration of the heating cycle of the HVAC system 100. That is, the controller 136 may operate and/or adjust operation of the HVAC system 100 (e.g., compressor 106) to cause the measured discharge pressure detected by the second sensor 152 to approach and/or reach the existing or current TDP until the call for heating received at block 204 is satisfied and operation of the HVAC system 100 is suspended. As mentioned above, when operation of the HVAC system 100 is suspended at the end of an operating cycle (e.g., heating cycle), the existing or established NTDP at the time of suspended operation may remain stored in the memory device 140 (e.g., database 142) for reference during execution of the method 200 (e.g., block 210) in a subsequent operating cycle (e.g., heating cycle, heating mode) of the HVAC system 100 (e.g., heat pump).

Based on a determination that the NTDP is less than the upper discharge pressure limit at block 222, the method 200 may proceed to block 226. At block 226, the controller 136 may initiate or start a timer ($T_{check}$), which may be one of the timers 144 (e.g., a third timer) of the controller 136. Upon initiation of the timer ($T_{check}$), a frequency (e.g., first frequency, measured frequency, actual frequency, detected frequency, frequency value) of the compressor 106 may be determined, and the frequency value may be established as a first frequency value (e.g., F1), as indicated by block 228. For example, the controller 136 may be configured to receive data and/or feedback from the compressor 106, the motor 132, and/or the VSD 134 indicative of a frequency applied to the compressor 106 (e.g., the motor 132) at the start of the timer ($T_{check}$). In some embodiments, one of the sensors 148 of the HVAC system 100 may be configured to detect the frequency of the compressor 106 and provide data indicative of the frequency to the controller 136 at the start of the timer ($T_{check}$) The first frequency value (F1) may be stored in the memory device 140, in some embodiments.

After the timer ($T_{check}$) runs for a designated time period (e.g., first designated time period), the method 200 proceeds to block 230. At block 230, an additional frequency (e.g., second frequency, measured frequency, actual frequency, detected frequency, frequency value) of the compressor 106 is determined at the end of the timer ($T_{check}$). The additional frequency value may be established as a second frequency value (e.g., F2) and may be stored in the memory device 140. The additional frequency value may be determined in any suitable manner, such as utilizing the techniques described above with reference to block 228. The duration of the timer ($T_{check}$, third timer, timer 144) may be any suitable time period, such as a predetermined or fixed time period (e.g., 90 seconds, 120 seconds, 150 seconds, etc.), which may be stored in the memory device 140.

The method 200 may then proceed to block 232. At block 232, the controller 136 may determine whether a difference between the additional frequency (F2) determined at block 230 and the frequency (F1) determined at block 228 is greater than zero. In other words, the controller 136 may be configured to subtract the frequency (F1) from the additional frequency (F2) at block 232.

Based on a determination that the difference between the additional frequency (F2) and the frequency (F1) is not greater than zero, the method 200 may proceed to block 234 of a second control scheme 236 of the method 200. The second control scheme 236, including block 234, is described in further detail below with reference to FIG. 7. Based on a determination (e.g., via the controller 136) that the difference between the additional frequency (F2) and the frequency (F1) is greater than zero at block 232, the method 200 may proceed to block 238 of the first control scheme 202 of the method 200. At block 238, the TDP (e.g., TDP value, current TDP value) may be set (e.g., updated) based on the current NTDP value. In other words, the current NTDP value may be established as a new or updated value of the TDP. The updated value of the TDP may be stored in the memory device 140. In this way, the TDP value may be increased, and the controller 136 may modulate operation of the compressor 106 to cause the measured discharge pressure of the working fluid (e.g., working fluid circuit 104) to approach the updated value of the TDP and improve efficiency of the HVAC system 100 in the heating mode. Thereafter, the first control scheme 202 of the method 200 may return to block 220, whereby the value of the NTDP may be updated in the manner described above.

In some instances, execution of the first control scheme 202 of the method 200 may include continual (e.g., repeated) execution of the steps at blocks 220, 222, 226, 228, 230, 232, and 238 in a loop or in succession. Thus, the values of the NTDP and the TDP may be iteratively increased, and the controller 136 may continually adjust operation of the compressor 106 to approach and/or achieve the updated (e.g., increased) TDP values. In this way, execution of the method 200 enables modulated operation of the compressor 106 during the operating cycle (e.g., heating mode, heating cycle) of the HVAC system 100 to satisfy the call for heating (e.g., based on a load or demand on the HVAC system 100). In particular, operation of the compressor 106 may be modulated without receipt of certain data (e.g., measured temperatures of the conditioned space) that would typically be provided by a communicating thermostat. The disclosed techniques therefore enable more efficient operation of the HVAC system 100 (e.g., heat pump) with the thermostat 146 (e.g., non-communicating thermostat) and/or other non-communicating HVAC equipment included in the HVAC system 100. Indeed, enabling modulated operation of the compressor 106 (e.g., variable capacity compressor) in embodiments of the HVAC system 100 that do not include communicating equipment (e.g., communicating thermostat) that is typically incorporated to provide modulated operation enables increased availability of modulated operations, which results in a reduction in power consumption (e.g., during heating cycles) in such embodiments of the HVAC system 100.

Figure 7:
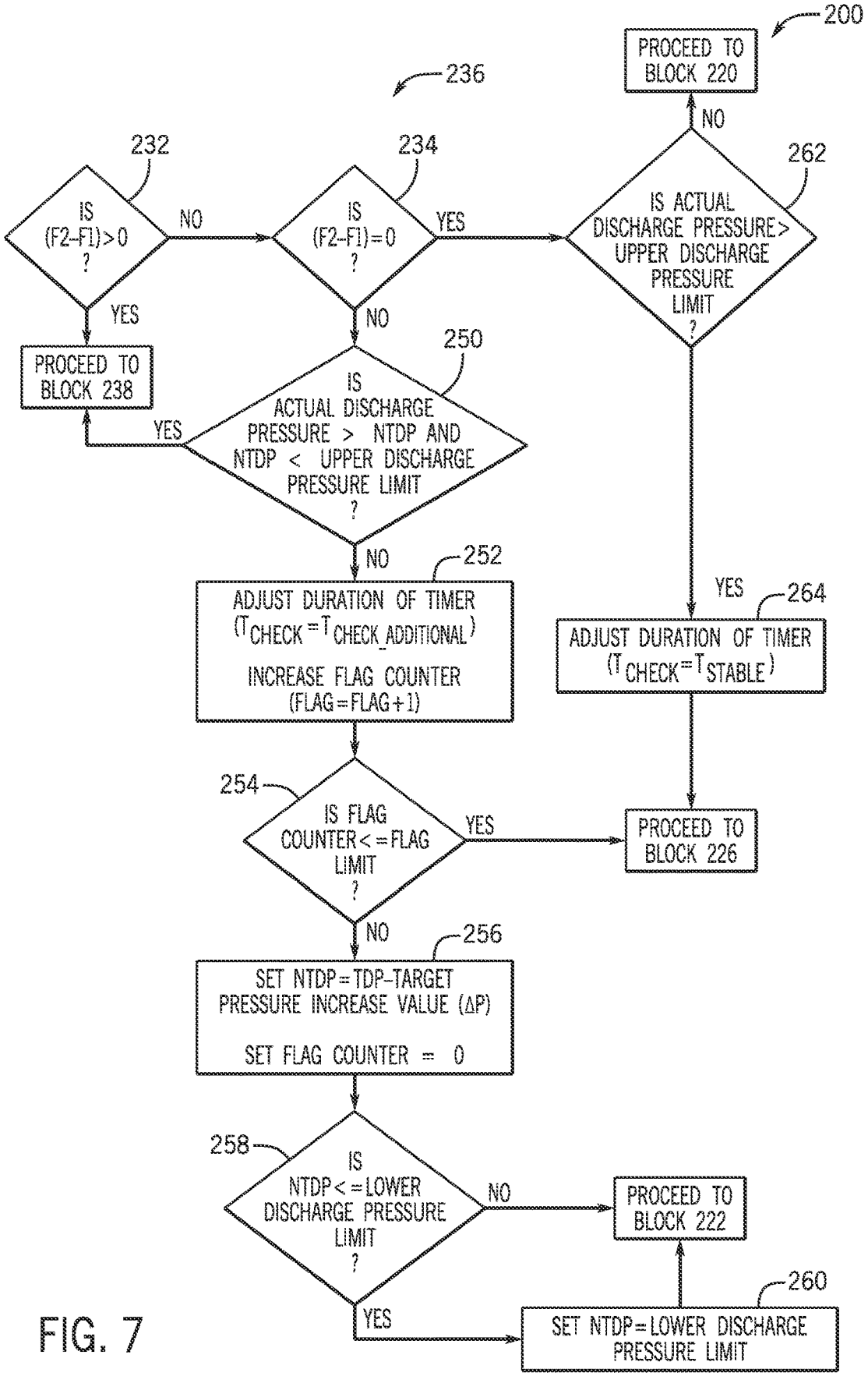
FIG. 7 is a process flow diagram of an embodiment of a method for controlling operation of an HVAC system, in accordance with an aspect of the present disclosure.

FIG. 7 is a process flow diagram of an embodiment of the method 200 (e.g., control sequence, one or more control sequences) for operating the HVAC system 100 (e.g., the compressor 106) to enable modulated operation of the compressor 106 and thereby enable more efficient operation of the HVAC system 100. For example, modulated operation of the compressor 106 enables reduced power consumption of the HVAC system 100 (e.g., heat pump) during a heating mode of the HVAC system 100 and also enables operation of the HVAC system 100 to heat a conditioned space with reduced production of greenhouse gases and other emissions. The illustrated embodiment depicts an embodiment of the second control scheme 236 of the method 200. As discussed above, the method 200 includes block 232, whereby the controller 136 may determine whether a difference between the additional frequency (F2) and the frequency (F1) determined at block 232 is greater than zero.

Based on a determination that the difference between the additional frequency (F2) and the frequency (F1) is not greater than zero, the method 200 may proceed to block 234. At block 234, the controller 136 may determine whether the difference between the additional frequency (F2) and the frequency (F1) is equal to zero. In response to a determination that the difference between the additional frequency (F2) and the frequency (F1) is not equal to zero (e.g., is less than zero), the method 200 may proceed to block 250. At block 250, the controller 136, for example, may determine whether an actual discharge pressure (e.g., measured discharge pressure value, detected discharge pressure value) is greater than the NTDP value determined (e.g., established, set) at block 220. For example, the controller 136 may receive feedback from the second sensor 152 indicative of the actual discharge pressure of the working fluid exiting the compressor 106, and the controller 136 may compare the actual discharge pressure to the NTDP value established at block 220. At block 250, the controller 136 may also compare the NTDP value established at block 220 to the upper discharge pressure limit determined (e.g., established, set) at block 208. In particular, the controller 136 may determine whether the NTDP value is less than the upper discharge pressure limit.

Based on a determination that the actual discharge pressure (e.g., detected by the second sensor 152) is greater than the NTDP value and a determination that the NTDP value is less than the upper discharge pressure limit, the method 200 may proceed to block 238 (e.g., of the first control scheme 202). As discussed above, at block 238, the TDP (e.g., TDP value, current TDP value) may be set (e.g., updated) based on the current NTDP value. That is, the current NTDP value may be established as a new or updated value of the TDP. Thereafter, the method 200 may continue (e.g., resume) execution of the first control scheme 202 in the manner described above.

Based on a determination that the actual discharge pressure (e.g., detected by the second sensor 152) is not greater (e.g., is equal to or less than) than the NTDP value at block 250, or based on a determination that the NTDP value is not less than (e.g., is equal to or greater than) the upper discharge pressure limit at block 250, the method 200 may proceed to block 252 of the second control scheme 236. At block 252, a duration of the timer ($T_{check}$) discussed above with reference to blocks 226, 228, and 230 may be adjusted. For example, the duration of the timer ($T_{check}$) may be adjusted from the first duration of time utilized in the first control scheme 202 to a second duration of time. In some embodiments, the second duration of time may be greater or longer than the first duration of time. For example, the first duration of time may be approximately 120 seconds, and the second duration of time may be approximately 150 seconds, 180 seconds, 210 seconds, or another suitable duration of time that is greater than the first duration of time. The updated duration of time of the timer (e.g., timer 144, third timer) may be stored in the memory device 140 and/or the database 142 (e.g., $T_{check_additional}$). Also at block 252, a flag counter of the HVAC system 100 (e.g., the controller 136) may be increased or incremented (e.g., by one unit, value, or count). For example, the flag counter may be a metric or other data stored in the memory device 140 and/or the database 142. Thus, at block 252, the count, metric, or other value associated with the flag counter and stored in the memory device 140 may be updated, such as increased by one, and the updated value may be stored in the memory device 140.

Thereafter, the method 200 may proceed to block 254. At block 254, the flag counter (e.g., a value of the flag counter) may be compared to a flag limit (e.g., via the controller 136). Similar to the flag counter, a value of the flag limit may be stored in the memory device 140 and/or the database 142. The value of the flag limit may be a predetermined and/or fixed value, such as an integer (e.g., 2, 3, etc.). The controller 136 may reference the value of the flag counter and the value of the flag limit stored in the memory device 140 to make the determination at block 254. In response to a determination that the flag counter is less than or equal to the flag limit, the method 200 may proceed to block 226 of the first control scheme 202 discussed above with reference to FIG. 6. From block 226, the method 200 may continue (e.g., resume) operation of the first control scheme 202 in the manner discussed above. However, it should be noted that the continued operation of first control scheme 202 may utilize the timer ($T_{check_additional}$) instead of the timer ($T_{check}$) based on the time duration adjustment performed at block 252. Thus, operation of the method 200 (e.g., execution of blocks 226, 228, and 230) may extend a greater length of time. The lapse of a greater length of time during execution of blocks 226, 228, and 230 may enable increased stabilization in operating parameters of the HVAC system 100 (e.g., working fluid discharge pressure), in some embodiments. For example, the increased length of time may enable the HVAC system 100 to more adequately or completely detect and/or assess operating parameters of the HVAC system 100, such as a load or demand (e.g., heating load) on the HVAC system 100.

In response to a determination that the flag counter is not less than or equal to (e.g., is greater than) the flag limit, the method 200 may proceed to block 256. At block 256, the controller 136 may set (e.g., establish) the NTDP (e.g., NTDP value, future TDP value, subsequent TDP value, expected TDP value) as an updated value. The updated or new value of the NTDP may be determined by subtracting the differential pressure value ($\Delta P$) (e.g., increment, predetermined value, fixed value, first differential pressure value) discussed above to the TDP (e.g., current TDP, designated at block 216). The updated value of the NTDP may be stored in the memory device 140 for reference during later operation of the method 200 (e.g., during a current heating or operating cycle of the HVAC system 100, during a subsequent heating operating cycle of the HVAC system 100). Additionally, at block 256, a value of the flag counter (e.g., stored in the memory device 140 and/or database 142) may be reset to a value of zero.

From block 256, the method 200 may continue to block 258, whereby the NTDP (e.g., NTDP value, updated NTDP value determined at block 256) may be compared to lower discharge pressure limit. For example, the controller 136 may be configured to compare the NTDP to the lower discharge pressure limit. As discussed above, the lower discharge pressure limit may be a value stored in the memory device 140 and/or database 142. In some embodiments, the lower discharge pressure limit may be a predetermined value that is designated based on any suitable parameters or factors, such as a type or model of the compressor 106, a capacity of the compressor 106, a configuration of the HVAC system 100, a model of the HVAC system 100, other operating conditions or limits of the HVAC system 100, testing data, empirical data, regulatory standards, target or desired operating (e.g., efficiency) metrics, or any combination thereof.

In response to a determination that the NTDP (e.g., future TDP value, subsequent TDP value, expected TDP value) is not less than or equal to (e.g., is greater than) the lower discharge pressure limit, the method 200 may proceed to block 222 of the first control scheme 202 discussed above with reference to FIG. 6. From block 222, the method 200 may continue (e.g., resume) operation of the first control scheme 202 in the manner discussed above. In response to a determination that the NTDP is less than or equal to the lower discharge pressure limit, the method 200 may proceed to block 260. At block 260, the lower discharge pressure limit may be set or established as the NTDP (e.g., NTDP value). For example, the controller 136 may store a value of the lower discharge pressure limit as the NTDP in the memory device 140 and/or database 142. In this way, operation of the HVAC system 100 at working fluid discharge pressures less than the lower discharge pressure limit may be avoided. From block 260, the method 200 may proceed to block 222 of the first control scheme 202 discussed above.

Returning to block 234, in response to a determination that the difference between the additional frequency (F2) and the frequency (F1) is equal to zero, the method 200 may proceed to block 262. At block 262, an actual discharge pressure of the HVAC system 100 may be compared to the upper discharge pressure limit (e.g., determined at block 208). For example, the controller 136 may receive feedback from the second sensor 152 indicative of a detected (e.g., current, actual) working fluid discharge pressure downstream of the compressor 106, and the controller 136 may compare the measured working fluid discharge pressure to the upper discharge pressure limit, which may be stored in the memory device 140. In particular, the controller 136 may determine whether the actual (e.g., measured, detected) working fluid discharge pressure is greater than the upper discharge pressure limit.

In response to a determination that the measured working fluid discharge pressure is not greater than the upper discharge pressure limit, the method 200 may proceed to block 220 of the first control scheme 202 discussed above with reference to FIG. 6. From block 220, the method 200 may continue (e.g., resume) operation of the first control scheme 202 in the manner discussed above. In response to a determination that the measured working fluid discharge pressure is greater than the upper discharge pressure limit, the method 200 may proceed to block 264. At block 264, a duration of the timer ($T_{check}$) discussed above with reference to blocks 226, 228, and 230 may be adjusted. For example, the duration of the timer ($T_{check}$) may be adjusted from the first duration of time utilized in the first control scheme 202 to a third duration of time (e.g., different from the second duration of time discussed above). In some embodiments, the third duration of time may be greater or longer than the first duration of time and greater or longer than the second duration of time. For example, the third duration of time may be approximately 240 seconds, 270 seconds, 300 seconds, 330 seconds, 360 seconds, or another suitable duration of time that is greater than the first duration of time and the second duration of time. The updated duration of time of the timer (e.g., timer 144, third timer) may be stored in the memory device 140 and/or the database 142 (e.g., $T_{stable}$).

After block 264, the method 200 may proceed to block 226 of the first control scheme 202 discussed above with reference to FIG. 6. From block 226, the method 200 may continue (e.g., resume) operation of the first control scheme 202 in the manner discussed above. As similarly discussed above, the continued operation of first control scheme 202 may utilize the timer ($T_{stable}$) instead of the timer ($T_{check}$). Thus, operation of the method 200 (e.g., execution of blocks 226, 228, and 230) may extend a greater length of time. The lapse of a greater length of time during execution of blocks 226, 228, and 230 may enable extended operation of the compressor 106 according to a particular TDP in instances when the additional frequency (F2) at the end of the timer (e.g., block 230) is not greater than and the frequency (F1) at the start of the timer (e.g., block 226). For example, an unexpected change in operating conditions of the HVAC system 100 may cause a change in operating parameters of the HVAC system 100, and the increased length of time may enable stabilization of the operating parameters and/or conditions of the HVAC system 100.

Figure 8:
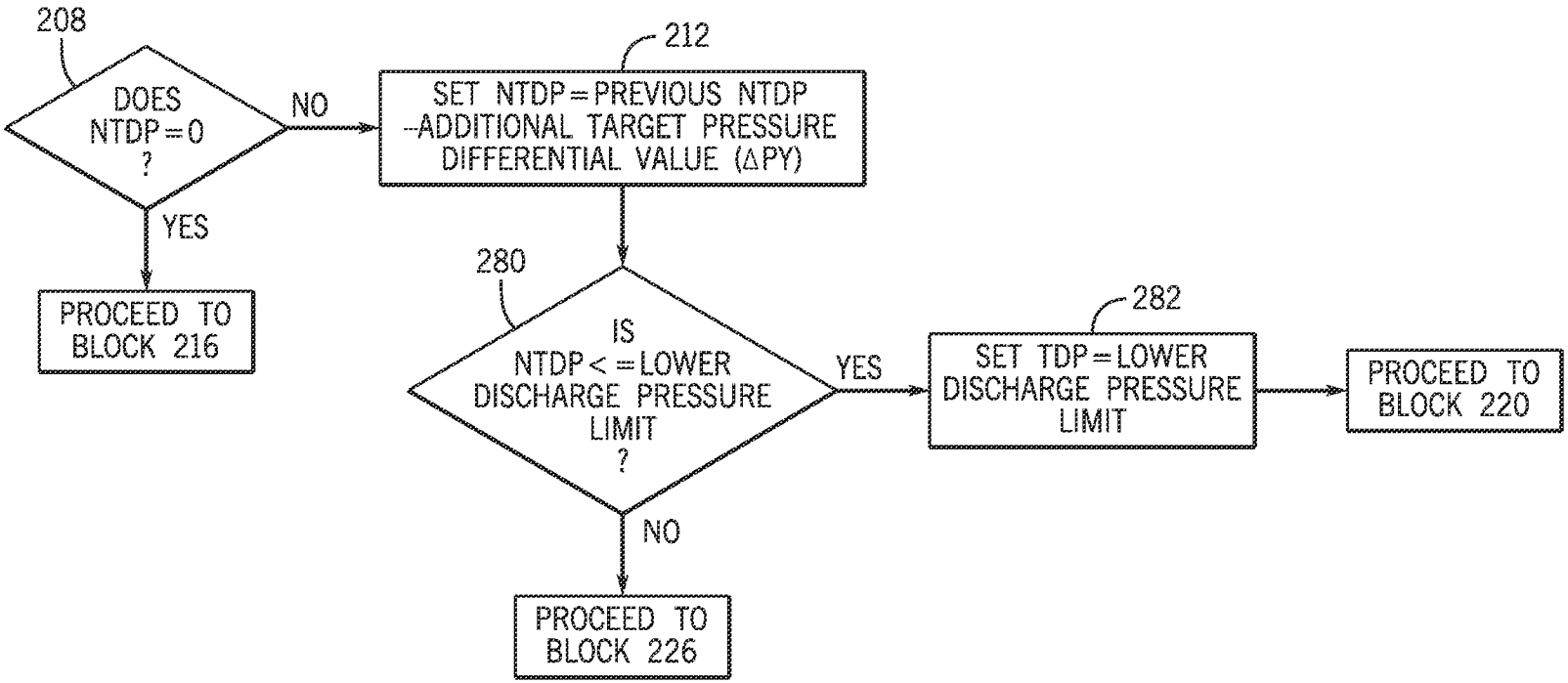
FIG. 8 is a process flow diagram of an embodiment of a method for controlling operation of an HVAC system, in accordance with an aspect of the present disclosure.

FIG. 8 is a process flow diagram of an embodiment of the method 200 (e.g., control sequence, one or more control sequences) for operating the HVAC system 100 (e.g., the compressor 106) to enable modulated operation of the compressor 106 (e.g., in a heating mode) and thereby enable more efficient operation of the HVAC system 100 (e.g., heat pump). In particular, the illustrated embodiment depicts an embodiment of the third control scheme 214 of the method 200. As discussed above, the method 200 includes block 210, whereby the controller 136 may determine whether an NTDP value (e.g., future TDP value, subsequent TDP value, expected TDP value) of the HVAC system 100 equals zero. The NTDP value may be stored in the memory device 140 and/or the database 142 and may be referenced by the controller 136 at block 210. In some instances, the NTDP value may be a value (e.g., a non-zero value) stored in the memory device 140 and may be associated with a previous (e.g., most recent) operating cycle (e.g., heating cycle) of the HVAC system 100. For example, the NTDP value referenced at block 210 may be the last NTDP value determined by the HVAC system 100 during a most recent heating cycle of the HVAC system 100. In other instances, the NTDP value may have a value of zero. For example, the NTDP may have a value of zero subsequent to a power interruption to the HVAC system 100 and/or subsequent to a hard reset of the HVAC system 100.

Based on a determination (e.g., via the controller 136) that the NTDP value does not equal zero at block 210, the method 200 may proceed to block 212. At block 212, the controller 136 may set (e.g., establish) an updated value as the NTDP. The updated or new value of the NTDP may be determined by adding an additional differential pressure value ($\Delta Py$) (e.g., additional decrement, additional predetermined value, additional fixed value, second differential pressure value) to the NTDP (e.g., previous NTDP, most recent NTDP) stored in the memory device 140. The additional differential pressure value may be an additional target pressure reduction value. In some embodiments, the additional differential pressure value may be stored in the memory device 140 (e.g., database 142) and may be referenced by the controller 136 to perform the step at block 212.

Additionally, the additional differential pressure value ($\Delta Py$) may be greater than the differential pressure value ($\Delta P$) discussed above with respect to block 220. The additional differential pressure value may be any suitable value having any suitable units (e.g., 0.1 MPa, 0.15 MPa, 0.2 MPa, or any other suitable value). The additional differential pressure value may be greater than the differential pressure value and may be subtracted from the NTDP, because at block 212 the method 200 utilizes the NTDP stored on the memory device 140 that is associated with a prior operation (e.g., most recent heating cycle) of the HVAC system 100. In other words, the NTDP stored on the memory device 140 and utilized at block 212 may be an NTDP value generated during prior execution of the method 200 during previous operation of the HVAC system 100 to satisfy a prior call for heating. Thus, as will be appreciated, the prior NTDP value may be a relatively high discharge pressure value. Accordingly, the NTDP value may be decreased at block 212 to enable more efficient operation of the HVAC system 100 (e.g., the compressor 106) without setting the NTDP as the lower discharge pressure limit (e.g., block 216), in some instances. The updated value of the NTDP determined at block 212 may be stored in the memory device 140 and/or database 142.

Following block 212, the method 200 may proceed to block 280. At block 280, the NTDP (e.g., updated NTDP value established at block 212) may be compared to a lower discharge pressure limit (e.g., lower discharge pressure value, minimum allowable discharge pressure value), which may be the same lower discharge pressure limit determined at block 208. For example, the controller 136 may be configured to compare the NTDP to the lower discharge pressure limit, which may be a value stored in the memory device 140 and/or database 142. In some embodiments, the lower discharge pressure limit may be a predetermined value that is designated based on any suitable parameters or factors, such as a type of the compressor 106, a capacity of the compressor 106, a model of the compressor 106, a configuration of the HVAC system 100, a model of the HVAC system 100, other operating parameters or limits of the HVAC system 100, testing data, empirical data, regulatory standards, target or desired operating (e.g., efficiency) metrics, or any combination thereof.

In response to a determination that the NTDP is not less than or equal to (e.g., is greater than) the lower discharge pressure limit, the method 200 may proceed to block 226 of the first control scheme 202 discussed above with reference to FIG. 6. From block 226, the method 200 may continue with operation of the first control scheme 202 in the manner discussed above. In response to a determination that the NTDP is less than or equal to the lower discharge pressure limit, the method 200 may proceed to block 282. At block 282, the lower discharge pressure limit value may be established or set as the TDP (e.g., TDP value), such as by the controller 136. Thus, the method 200 may avoid operation of the HVAC system 100 with a TDP that is less than the lower discharge pressure limit of the HVAC system 100. Thereafter, the method 200 may proceed to block 220 of the first control scheme 202, and the method 200 may continue with operation of the first control scheme 202 in the manner discussed above.

The present disclosure may provide one or more technical effects useful in the operation of an HVAC system. In particular, the disclosed systems and methods enable to enable variable operation of modulating HVAC equipment, such as a compressor, when the modulating HVAC equipment is utilized with non-modulating (e.g., non-communicating) HVAC equipment, such as a non-communicating thermostat and/or a non-communicating air handler. For example, present embodiments implement a variable target discharge pressure to enable modulating of the compressor of the HVAC system (e.g., without use of data or feedback typically provided by communicating HVAC equipment) during a heating mode of the HVAC system (e.g., heat pump). In this way, the disclosed systems and methods enable more efficient operation of the HVAC system to satisfy a load or demand (e.g., a heating demand) on the HVAC system with reduced energy consumption and reduced production of emissions.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A heat pump, comprising:

a variable capacity compressor; and a controller communicatively coupled to the variable capacity compressor and configured to:

receive a call for heating;

determine an upper discharge pressure limit of the heat pump;

determine a lower discharge pressure limit of the heat pump;

determine a target discharge pressure value, wherein the target discharge pressure value is less than or equal to the upper discharge pressure limit and is greater than or equal to the lower discharge pressure limit;

determine an expected target discharge pressure value based on the target discharge pressure value;

store the expected target discharge pressure value in a memory of the controller; and modulate operation of the variable capacity compressor such that a detected discharge pressure of the heat pump approaches the target discharge pressure value, wherein the controller is configured to increase the target discharge pressure value by a differential pressure value to determine the expected target discharge pressure value.

2. The heat pump of claim 1, wherein, subsequent to the determination of the upper discharge pressure limit and the determination of the lower discharge pressure limit, the controller is configured to set the lower discharge pressure limit as the target discharge pressure value in response to a determination that the expected target discharge pressure value is absent from the memory.

3. The heat pump of claim 1, wherein the controller is configured to compare the expected target discharge pressure value to the upper discharge pressure limit and, in response to the expected target discharge pressure value being greater than or equal to the upper discharge pressure limit, set the upper discharge pressure limit as the expected target discharge pressure value.

4. The heat pump of claim 1, wherein the controller is configured to receive the call for heating from a non-communicating thermostat.

5. The heat pump of claim 4, wherein the call for heating comprises a 24-volt electrical signal.

6. The heat pump of claim 5, wherein, in response to receipt of the call for heating, the controller is configured to initially operate the variable capacity compressor at a minimum allowable frequency for an initial time period.

7. The heat pump of claim 6, wherein the controller is configured to determine the upper discharge pressure limit and the lower discharge pressure limit in response to lapse of the initial time period.

8. A controller of a heat pump, wherein the controller comprises a non-transitory, computer-readable medium having instructions stored thereon that, when executed by processing circuitry of the controller, are configured to cause the controller to:

receive a call for heating from a non-communicating thermostat;

determine an upper discharge pressure limit of the heat pump;

determine a lower discharge pressure limit of the heat pump;

determine a target discharge pressure value of the heat pump, wherein the target discharge pressure value is less than or equal to the upper discharge pressure limit and is greater than or equal to the lower discharge pressure limit;

iteratively increase the target discharge pressure value; and modulate operation of a compressor of the heat pump based on the target discharge pressure value.

9. The controller of claim 8, wherein the instructions, when executed by the processing circuitry, are configured to cause the controller to iteratively increase the target discharge pressure value by a differential pressure value.

10. The controller of claim 8, wherein the instructions, when executed by the processing circuitry, are configured to cause the controller to:

operate a timer for a designated time period;

determine a first frequency applied to the compressor at a start of the timer;

determine a second frequency applied to the compressor at an end of the timer;

compare the first frequency to the second frequency; and increase the target discharge pressure value by a differential pressure value in response to a determination that the second frequency is greater than the first frequency.

11. The controller of claim 10, wherein the instructions, when executed by the processing circuitry, are configured to cause the controller to:

receive data indicative of a measured discharge pressure value of the heat pump from a sensor; and in response to a determination that the second frequency is equal to the first frequency:

compare the measured discharge pressure value to the upper discharge pressure limit; and increase the target discharge pressure value by the differential pressure value in response to a determination that the measured discharge pressure value is not greater than the upper discharge pressure limit.

12. The controller of claim 11, wherein the instructions, when executed by the processing circuitry, are configured to cause the controller to increase a time duration of the designated time period in response to a determination that the measured discharge pressure value is greater than the upper discharge pressure limit.

13. The controller of claim 8, wherein the controller is configured to receive a 24-volt electrical signal as the call for heating.

14. The controller of claim 8, wherein the instructions, when executed by the processing circuitry, are configured to cause the controller:

retrieve a first stored predetermined value to determine the upper discharge pressure limit; and retrieve a second stored predetermined value to determine the lower discharge pressure limit.

15. A heat pump, comprising:

a compressor configured to operate at variable capacities; and a controller configured to communicatively couple to the compressor, wherein the controller is configured to:

receive a call for heating from a non-communicating thermostat; and in response to receipt of the call for heating:

establish a lower discharge pressure limit of the heat pump;

establish an upper discharge pressure limit of the heat pump;

determine a target discharge pressure value, wherein the target discharge pressure value is less than or equal to the upper discharge pressure limit and is greater than or equal to the lower discharge pressure limit;

modulate operation of the compressor such that a detected discharge pressure of the heat pump approaches the target discharge pressure value; and iteratively increase the target discharge pressure value by a differential pressure value.

16. The heat pump of claim 15, wherein the controller is configured to determine the target discharge pressure value based on a value of an expected target discharge pressure value stored on a memory of the controller.

17. The heat pump of claim 16, wherein the value of the expected target discharge pressure value is associated with a prior heating cycle of the heat pump and the controller is configured to store the value of the expected target discharge pressure value on the memory at an end of the prior heating cycle.

* * * * *